US007118499B1

(12) United States Patent
Ling

(10) Patent No.: US 7,118,499 B1
(45) Date of Patent: Oct. 10, 2006

(54) EASY TABLE TENNIS TRAINING DEVICE

(76) Inventor: Jung Pin Ling, No. 5, Lane Hsiyuan, Chiaonan Rd., Chiaotou Hsiang, Kaohsiung Hsien (TW)

( * ) Notice: Subject to any disclaimer, the term of this patent is extended or adjusted under 35 U.S.C. 154(b) by 0 days.

(21) Appl. No.: 11/149,244

(22) Filed: Jun. 10, 2005

(51) Int. Cl.
*A63B 69/00* (2006.01)

(52) U.S. Cl. ..... 473/459

(58) Field of Classification Search ..... 473/422, 473/459, 473–475
See application file for complete search history.

(56) References Cited

U.S. PATENT DOCUMENTS

| | | | | |
|---|---|---|---|---|
| 6,398,671 | B1 * | 6/2002 | Rios | 473/417 |
| 6,475,108 | B1 * | 11/2002 | Sarenana et al. | 473/420 |
| 6,884,185 | B1 * | 4/2005 | Udwin et al. | 473/417 |
| 6,893,363 | B1 * | 5/2005 | Chen et al. | 473/417 |

* cited by examiner

*Primary Examiner*—Raleigh W. Chiu
(74) *Attorney, Agent, or Firm*—Troxell Law Office, PLLC

(57) ABSTRACT

An easy table tennis training device comprises a retaining mount, a swing member, a telescopic tube, and a retaining seat wherein the retaining mount is made up of a base and an accommodating case with a receiving cavity fixed on top of the base thereon for the accommodation of a mattress element therein, and the swing member has a central screw hole defining therein to register with a locking fitting and a plurality of washers thereby. The telescopic tube is composed of a fixed rod, an adjustable rod, a fixing element, a locking element, and a sleeve tube wherein the fixed rod has a central cylindrical channel and an engaging portion protruding at the bottom end thereof, the adjustable rod has a coupling end protruding at the upper section and an elongated recessed groove appropriately defining the lower section thereon, and the sleeve tube has a central pivoting hole to form an abutting face therein with an O-shaped ring reciprocally mounted thereto. The retaining seat has an opening communicating with a retaining cavity for accommodating a ball element therein, an abutting section annularly extending at the upper edge thereon, and an engaged end extending at the bottom section thereof. Therefore, via the base, the retaining mount can be stably put onto various appropriate locations and the telescopic tube can be appropriately adjusted in height according to that of a player and the desirable stroke position thereof. And more than one of the table tennis training devices can be simultaneously applied, permitting a player to do incessant forehand and backhand stroke practice. Besides, the present invention can be easily carried for training at any time as pleased, economically achieving more convenient and flexible application thereof.

19 Claims, 6 Drawing Sheets

EASY TABLE TENNIS TRAINING DEVICE

BACKGROUND OF THE INVENTION

The present invention is related to an easy table tennis training device, comprising a retaining mount, a swing member, a telescopic tube, and a retaining seat wherein the retaining mount is made up of a base and an accommodating case fixed on top of the base thereof for the accommodation of a mattress element therein, and the swing member screw-joined to the lower end of the telescopic tube thereof is connected to an appropriated position of the mattress element thereon; the upper end of the telescopic tube is reciprocally engaged with the retaining seat having a retaining cavity defining thereon for the accommodation of a ball element therein; whereby, the present invention can be easily carried for a player to practice strokes of table tennis at any time and place as pleased, facilitating more convenient application of the present invention and achieving the economical efficiency thereof.

A conventional table tennis training device on the market is characterized by the application of a robot and a table tennis table wherein, in training thereof, accessory equipment must be prepared first such as a matched net being mounted and multiple ping-pong balls being accommodated into the robot thereof. After the balls accommodated at the robot therein is shot and used up, the balls must be retrieved and relocated for another round of practice, which is rather time-consuming and painful in the process thereof. And, in addition to the relatively high price thereof, the conventional table tennis training device is also huge in volume that can pose a time and place limitation for the training thereof and fail to provide sufficient practice at any time and place for a player as pleased. Therefore, the conventional table tennis training device is rather inconvenient in application and uneconomical in the table tennis training purpose thereof.

SUMMARY OF THE PRESENT INVENTION

It is, therefore, the primary purpose of the present invention to provide an easy table tennis training device, comprising a retaining mount, a swing member, a telescopic tube, and a retaining seat reciprocally engaged and assembled into a table tennis training device that can be easily carried and stably put onto various appropriated locations as desired for practicing the strokes of table tennis, efficiently achieving more convenient application of the present invention.

It is, therefore, the second purpose of the present invention to provide an easy table tennis training device wherein the swing member can be swung back and forth so that a player can utilize a single ball element to do incessant ping-pong stroke practice thereof, facilitating time-saving and effortless application of the present invention to achieve the economical efficiency thereof.

It is, therefore, the third purpose of the present invention to provide an easy table tennis training device wherein an adjustable rod of the telescopic tube can be freely moved upwards or downwards to adjust the height of the telescopic tube according to that of a player and of desirable stroke position of the ball element, providing more flexible and convenient application of the present invention thereof.

It is, therefore, the fourth purpose of the present invention to provide an easy table tennis training device wherein, via the binding and positioning effect of a sleeve tube and a O-shaped ring of the telescopic tube thereof, the adjustable rod accommodated at a fixed rod therein can be stably adjusted upwards or downwards and precisely refrain from the risk of shaking to and fro to achieve the best using state thereby.

It is, therefore, the fifth purpose of the present invention to provide an easy table tennis training device wherein more than one of the present invention can be simultaneously placed onto any appropriate locations so that a player, coordinating with the footwork, can practice a full-scale and incessant left/right strokes of the ball elements for the training thereof.

DETAILED DESCRIPTION OF THE PREFERRED EMBODIMENTS

Figure 1:
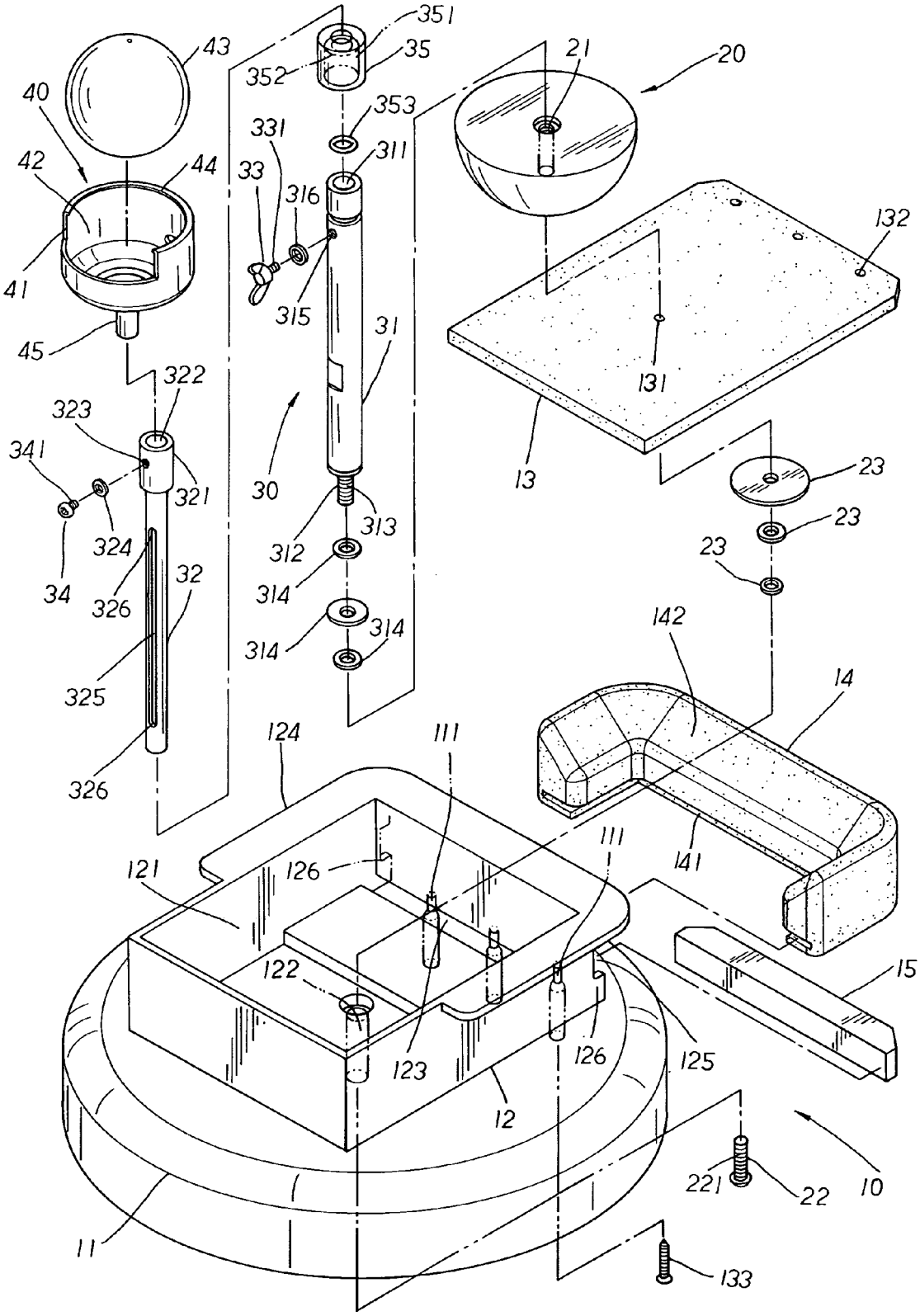
FIG. 1 is an exploded perspective view of the present invention.

Please refer to FIG. 1 showing an exploded perspective view of the present invention. The present invention is related to an easy table tennis training device, comprising a retaining mount 10, a swing member 20, a telescopic tube 30, and a retaining seat 40. The retaining housing 10 is made up of an annular disk-shaped base 11 integrally molded of metallic or plastic material with a plurality of assembly holes 111 equidistantly arranged at predetermined positions of one side thereon, and on top of the base 11 is fixedly attached a plastic-molded accommodating case 12 with a receiving cavity 121 defining therein for the accommodation of a soft mattress element 13 that, made of plastic or rubber material, is equipped with a through hole 131 disposed at a predetermined position thereon. The accommodating case 12 is made in a rectangular shape having a stepwise bottom surface and a positioning thru-hole 122 disposed at a predetermined position to reciprocally communicate with the base 11 thereby wherein the positioning thru-hole 122 can be formed in a circular stepwise shape or other various shapes. The accommodating case 12 also includes a guide space 123 disposed at the bottom surface of one lateral side thereon, and a connecting flange 124 appropriately protruding at the upper peripheral edge thereon to be reciprocally engaged with a coupling groove 141 of a stop member 14 thereby wherein the connecting flange 124 thereof is identically molded in conformance with the stop member 14 in a U shape or any other shapes thereof, and beneath the connecting flange 124 thereof is disposed a receiving space 125 for the accommodation of a pressing abutment member 15 therein with a pair of abutting support sections 126 symmetrically extending at both sides of the receiving space 125 thereof. The mattress element 13 is equipped with a plurality of fixing holes 132 and screw fittings 133 appropriately disposed at one lateral side thereon to reciprocally connect with the assembly holes 111 of the base 11 thereby, and the stop member 14 has an oblique-sloped stop surface 142 defining thereon. The swing member 20 is made in a semi-spherical shape, having a screw hole 21 extending at the center there-through, a locking fitting 22 defined by external threads 221 thereon, and a plurality of washers 23 in reciprocal registration therewith. The locking fitting 22 is also matched with the positioning thru-hole 122 of the accommodating case 12 thereof. The telescopic tube 30 is composed of a fixed rod 31, an adjustable rod 32, a fixing element 33, a locking element 34, and a sleeve tube 35. The fixed rod 31 has a cylindrical channel 311 extending at the center therein for the accommodation of the matched adjustable rod 32 therein, an engaging portion 312 with an externally-threaded section 313 defining thereon and a plurality of washer units 314 mounted thereto protruding at the bottom end thereof, a threaded thru-hole 315 appropriately disposed at the outer periphery at one side of the upper end in communication with the cylindrical channel 311 thereof, and a washer part 316 mounted thereto to reciprocally register with an outer threaded portion 331 of the fixing element 33 thereof. The adjustable rod 32 has a coupling end 321 defined by a coupling hole 322 protruding at the upper section thereof, a screwed thru-hole 323 appropriately disposed at the outer periphery of one side in communication with the coupling hole 322 thereof, and a washer fitting 324 applied thereto to reciprocally engage with an externally threaded end 341 of the locking element 34 thereby. The adjustable rod 32 also includes an elongated recessed groove 325 defining a predetermined position at the outer periphery of the lower section thereof to form a limiting side 326 at both upper and lower edges respectively. The sleeve tube 35 is equipped with a two-stepwise pivoting hole 351 disposed at the center thereof to form an abutting face 352 therein, and an O-shaped ring 353 reciprocally mounted thereto. The retaining seat 40 has an opening 41 disposed thereon, a retaining cavity 42 communicating with the opening 41 thereof for the accommodation of a ball element 43 therein, an abutting section 44 annularly extending at the upper edge thereon, and an engaged end 45 extending at the bottom section thereof to be reciprocally joined to the coupling end 321 of the adjustable rod 32 thereof.

Figure 2:
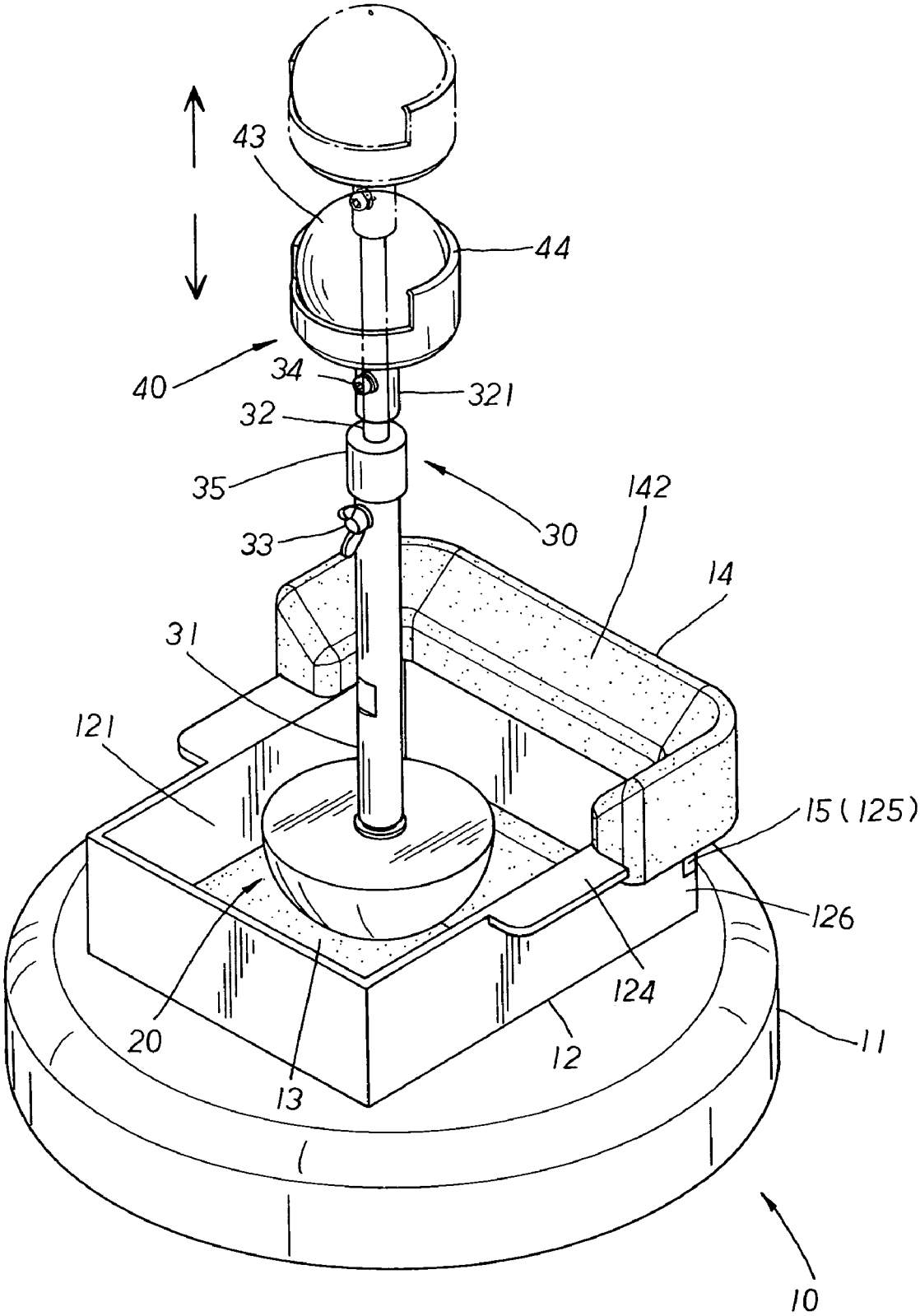
FIG. 2 is an assembled perspective view of the present invention in adjustment thereof.
Figure 3:
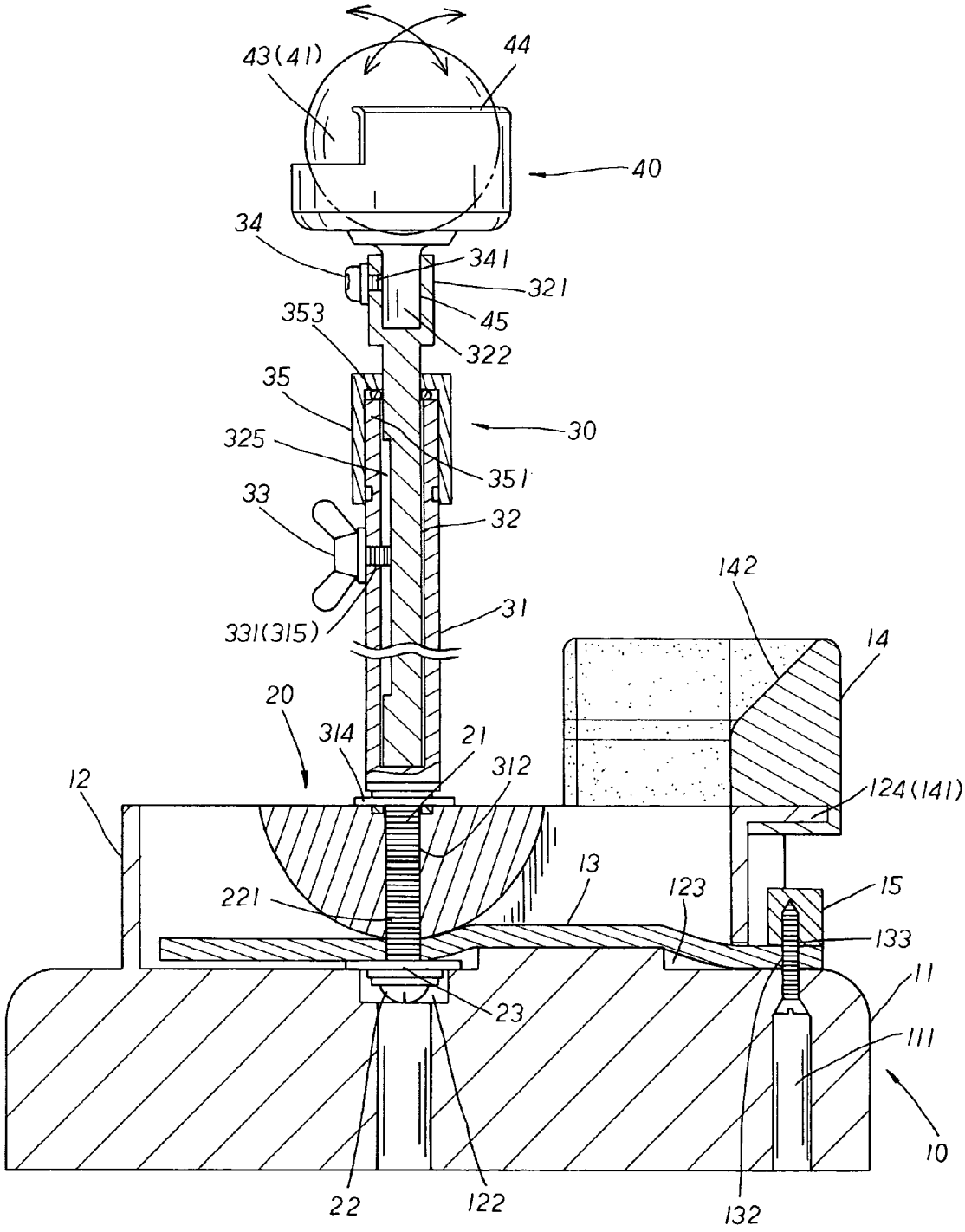
FIG. 3 is an assembled cross sectional view of the present invention.

Please refer to FIGS. 2 to 3 inclusive. In assembly, the mattress element 13 is placed into the receiving cavity 121 of the accommodating case 12 with one side thereof led through the guide space 123 thereof to extend outwards there-from and the fixing holes 132 disposed thereon to precisely match with the assembly holes 111 of the base 11 thereof. The swing member 20 is then put onto the mattress element 13 accommodated at the retaining mount 10 therein, permitting the screw hole 21 thereof to correspondingly align with the through hole 131 of the mattress element 13 thereby. The multiple washers 23 are sequentially mounted to the external threads 221 of the locking fitting 22 that is led from the positioning thru-hole 122 of the accommodating case 12 to thread through the through hole 131 of the mattress element 13 till fixedly secured to the lower section of the screw hole 21 of the swing member 20 thereof. The pressing abutment member 15 is guided from one side of the accommodating case 12 to locate at the receiving space 125 therein and pressingly abut against the top surface of the mattress element 13 thereof. The screw fittings 133 are then screwed up through the assembly holes 111 of the base 11 and the fixing holes 132 of the mattress element 13 respectively till securely locked up with the pressing abutment member 15 thereof. The engaging portion 312 of the fixed rod 31 with the externally-threaded section 313 defining thereon is reciprocally locked to the upper section of the screw hole 21 of the swing member 20, and the coupling groove 141 of the stop member 14 is correspondingly joined to the connecting flange 124 of the accommodating case 12 till the end edge of the connecting flange 124 thereof precisely abutted against the inner wall disposed at the end edge of the coupling groove 141 thereof. The O-shaped ring 353 of the sleeve tube 35 is then accommodated into the pivoting hole 351 thereof and limited in position therein via the abutting face 352 thereof. And the pivoting hole 351 of the sleeve tube 35 is guided and mounted to the fixed rod 31, permitting the outer periphery defining the upper end surface of the fixed rod 31 to abut against one side of the O-shaped ring 353 in a close and secure engagement therewith. Then, the adjustable rod 32 is applied from the bottom end thereof to sequentially insert with the pivoting hole 351 of the sleeve tube 35 and the cylindrical channel 311 of the fixed rod 31 till accommodated at an appropriate position of the cylindrical channel 311 therein. The fixing element 33 is then guided through the washer part 316 of the fixed rod 31, permitting the outer-threaded portion 331 thereof to reciprocally lock with the threaded thru-hole 315 of the fixed rod 31 and pressingly abut against the inner wall of the recessed groove 325 of the adjustable rod 32 for secure location thereof. Then, the engaged end 45 of the retaining seat 40 is mounted to the coupling hole 322 of the coupling end 321 protruding at the upper section of the adjustable rod 32 thereof, and the externally-threaded end 341 of the locking element 34 is led through the washer fitting 324 of the adjustable rod 32 to reciprocally screw up with the screwed thru-hole 323 thereof till abutted tight at an appropriate position of the engaged end 45 of the retaining seat 40 thereof. The ball element 43 is guided through the opening 41 of the retaining seat 40 to accommodate at the retaining cavity 42 therein, permitting the abutting section 44 extending at the upper edge of the retaining seat 40 thereof to appropriately limit the position of the ball element 43 accommodated therein so as to refrain the ball element 43 from falling outward there-from to complete the assembly of the present invention.

Figure 4:
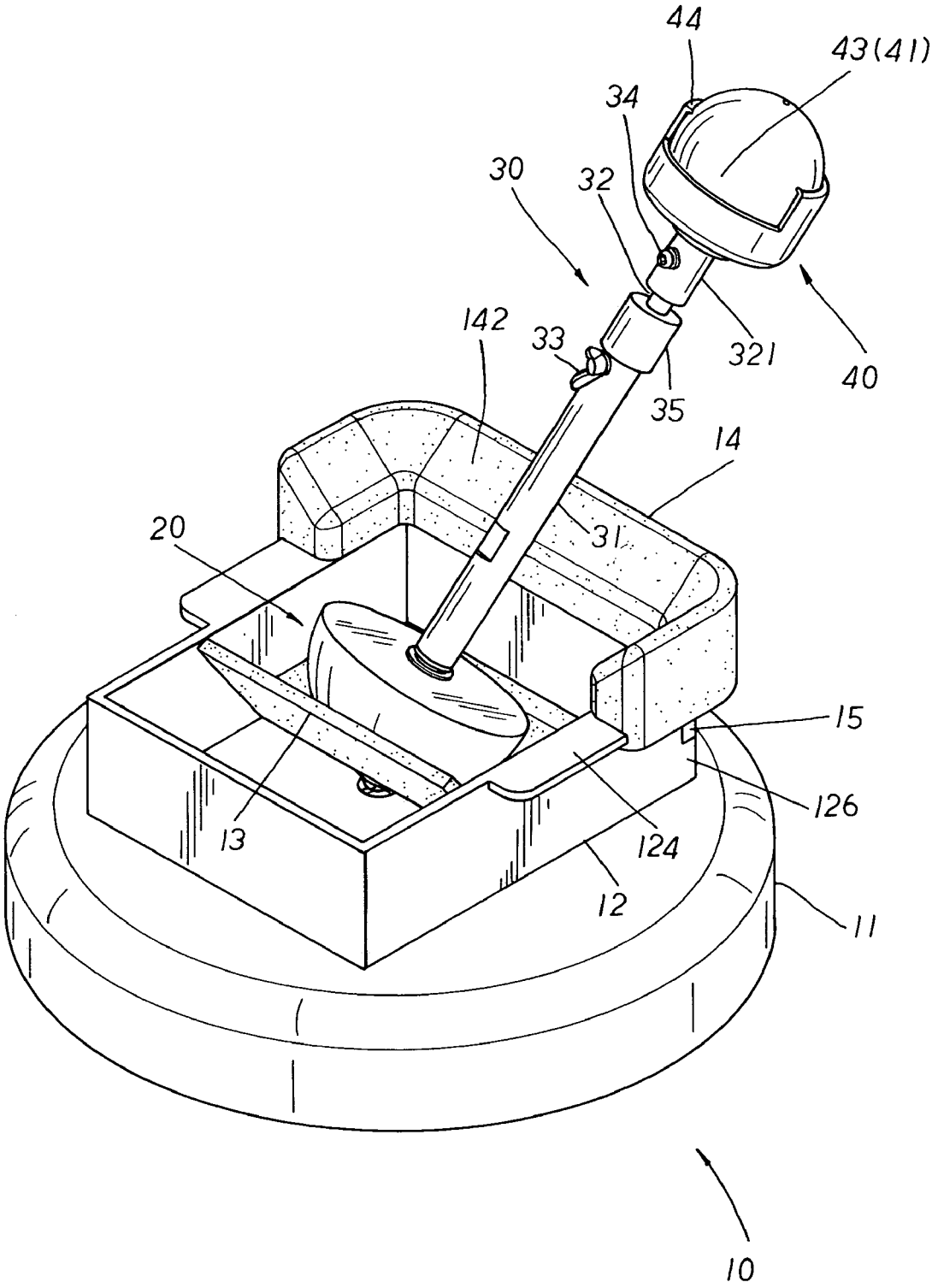
FIG. 4 is a diagram showing the present invention in a state of operation.
Figure 5:
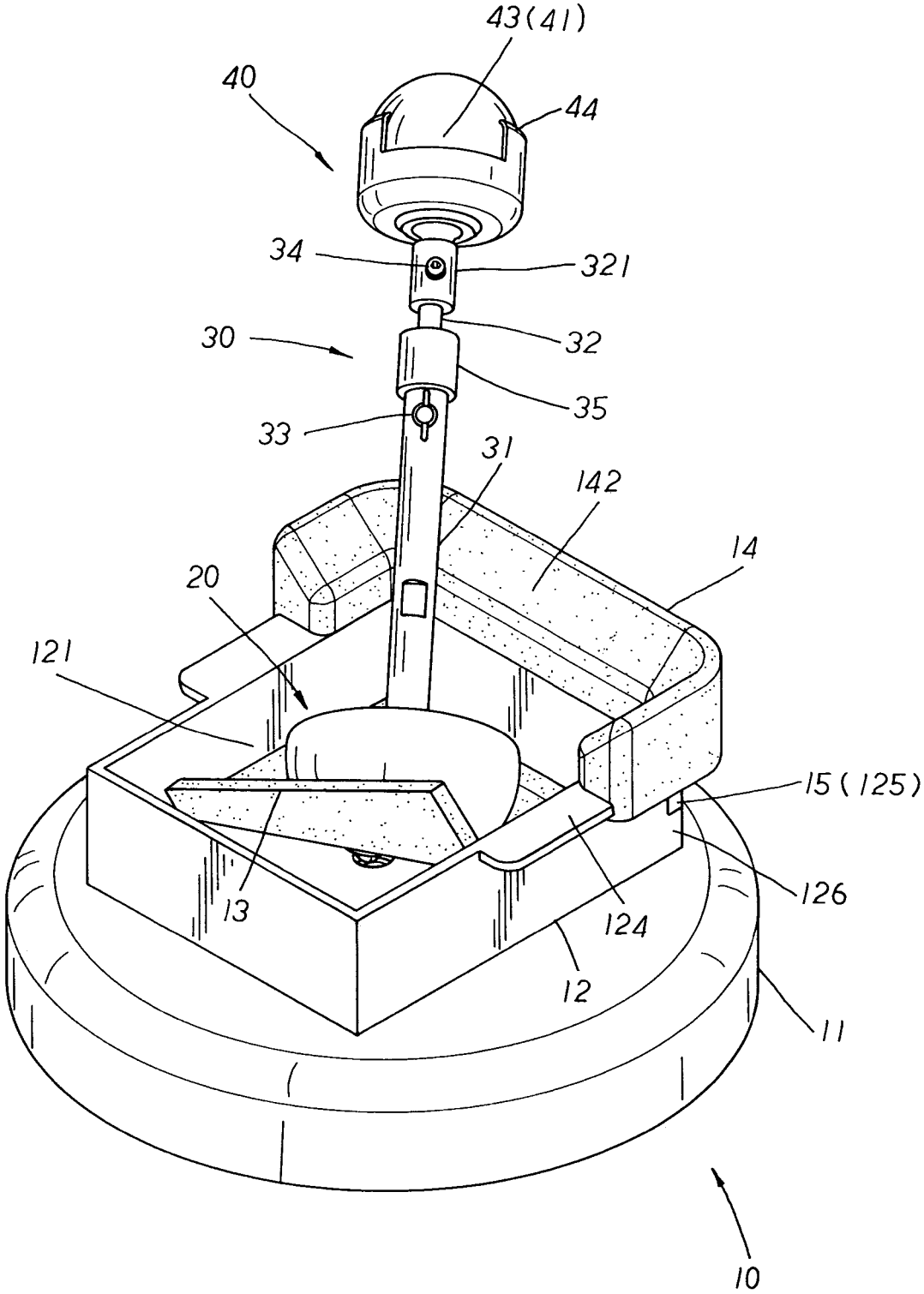
FIG. 5 is a second diagram showing the present invention in another state of operation.
Figure 6:
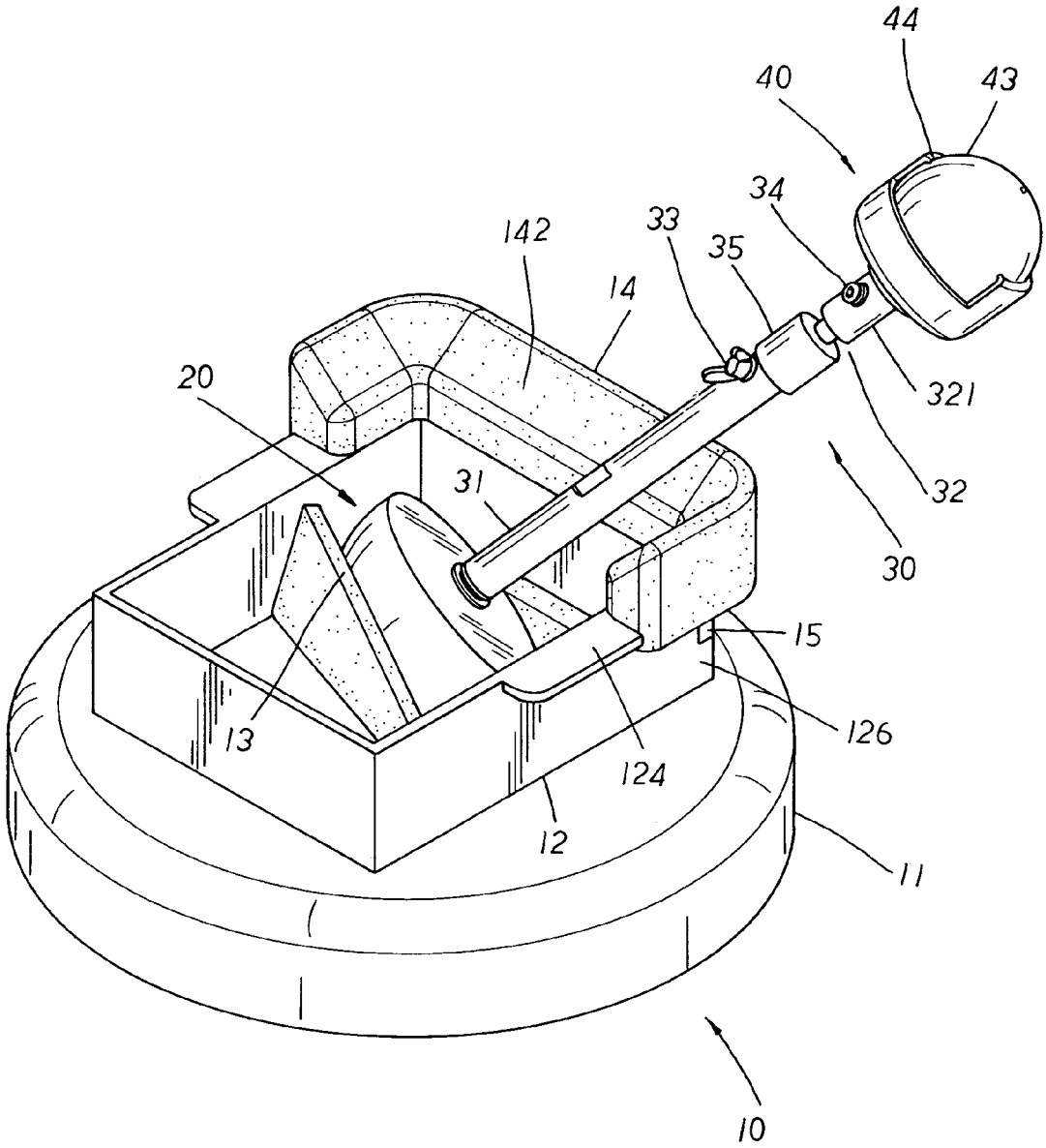
FIG. 6 is a third diagram showing the present invention in a third state of operation.

In application, via the base 11 thereof, the retaining mount 10 can be stably placed onto a table surface or platform of various locations and appropriate height for table tennis practice and training. Depending on the height of a player and the desired stroke position of the ball element 43 thereof, the telescopic tube 30 can be appropriately adjusted in height as shown in FIG. 2. The outer-threaded portion 331 of the fixing element 33 is unscrewed outwards for a proper length so that the adjustable rod 32 can freely ascend or descend at the cylindrical channel 311 of the fixed rod 31 therein till adjusted into an appropriate and desirable position before securely screwed up again at the adjusted position by the fixing element 33 thereof. And, via the upper/lower limiting sides 326 thereof, the outer-threaded portion 331 of the fixing element 33 is restrained to locate at the elongated recessed groove 325 therein. Then, the player can practice strokes at the ball element 43 accommodated at the retaining cavity 42 of the retaining seat 40 therein. Coordinating with the footwork thereof, the player can do incessant forehand/backhand strokes of the ball element 43 from the center as shown in FIG. 4, the forehand/backhand strokes thereof from the left as shown in FIG. 5, and the forehand/backhand strokes from the right as shown in FIG. 6. Meanwhile, the retaining seat 40 along with the telescopic tube 30 and the swing member 20 affected by the stroke thereof will swing transversely to one side accordingly, causing the mattress element 13 of the retaining mount 10 to lift upwards thereby. And the stop surface 142 of the stop member 14 can provide a buffering effect to limit the position and absorb the shock thereof, permitting the swing member 20 to immediately swing backwards to its former position thereof. Besides, when practicing strokes in aggressive drive, the ball element 43 accommodated at the retaining seat 40 therein will spin at the retaining cavity 42 therein as shown in FIG. 3. And via the binding and positioning effect of the sleeve tube 35 and the O-shaped ring 353 of the telescopic tube 30 thereof, the adjustable rod 32 accommodated at the fixed rod 31 therein can be stably adjusted upwards or downwards in height without the risk of shaking to and fro to achieve the best using state thereby. Therefore, according to the need of a player, the present invention can be easily carried to provide convenient table tennis training and practice without the limitation of time and place. Besides, the single ball element 43 is economically utilized for repeated practice thereof, facilitating a convenient and flexible application of the present invention to efficiently boost the ping-pong stroke technique of the player within a short period of time.

What is claimed is:

1. An easy table tennis training device, comprising a retaining mount, a swing member, a telescopic tube, and a retaining seat wherein the retaining mount is made up of a base and an accommodating case with a receiving cavity fixed on top of the base thereof for the accommodation of a movable mattress element therein, and the swing member screw-joined to the lower end of the telescopic tube thereof is connected to an appropriated position of the mattress element thereon; the upper end of the telescopic tube is reciprocally engaged with the retaining seat having a retaining cavity defining thereon for the accommodation of a ball element therein; therefore, via the base thereof, the retaining mount can be stably put onto a table surface or platform of various locations and appropriate height, and depending on the height of a player and the desirable stroke position thereof, the telescopic tube can be appropriately adjusted in height, permitting the player to practice strokes at the ball element accommodated in the retaining cavity of the retaining seat thereof; via the swinging back and forth of the swing member thereof, the player can utilize the single ball element and coordinate with the footwork thereof to do incessant aggressive drive practice like forehand strokes, forehand topspins, backhand strokes, and backhand topspins, etc., efficiently boosting the stroke technique of a player within a short period of time to achieve more convenient and flexible application of the present invention with economical efficiency thereof.

2. The easy table tennis training device as claimed in claim 1 wherein the base of the retaining mount has a plurality of assembly holes equidistantly arranged at predetermined positions of one side thereon, and the mattress element thereof is equipped with a through hole disposed at a predetermined position thereon and a plurality of fixing holes to reciprocally match with the assembly holes of the base and fixedly secured therewith via screw fittings thereby; the accommodating case has a locking thru-hole disposed at a predetermined position thereon, a guide space disposed at the bottom surface of one lateral side thereon, and a connecting flange appropriately protruding at the upper peripheral edge thereon to define a receiving space there-beneath with a pair of abutting support sections symmetrically extending at both sides of the receiving space thereof.

3. The easy table tennis training device as claimed in claim 2 wherein the positioning thru-hole of the accommodating case thereof is made in a circular stepwise shape.

4. The easy table tennis training device as claimed in claim 2 wherein the positioning thru-hole of the accommodating case thereof is reciprocally matched with the locking fitting and identically conformed in various shapes therewith.

5. The easy table tennis training device as claimed in claim 2 wherein the connecting flange of the accommodating case thereof can be made in a U shape.

6. The easy table tennis training device as claimed in claim 2 wherein the connecting flange of the accommodating case thereof is identically shaped to match with the stop member and can be uniformly molded into various shapes therewith accordingly.

7. The easy table tennis training device as claimed in claim 2 wherein the stop member thereof is provided with a coupling groove to precisely match and engage with the connecting flange of the accommodating case thereby.

8. The easy table tennis training device as claimed in claim 7 wherein the stop member thereof has an oblique-sloped stop surface defining thereon.

9. The easy table tennis training device as claimed in claim 2 wherein the receiving space of the accommodating case thereof can have a matched pressing abutment member mounted thereto.

10. The easy table tennis training device as claimed in claim 1 wherein the swing member thereof is equipped with a screw hole extending at the center there-through to reciprocally match with a locking fitting defined by external threads and a plurality of washers for secure mutual engagement therewith.

11. The easy table tennis training device as claimed in claim 10 wherein the swing member thereof is made in a semi-spherical shape.

12. The easy table tennis training device as claimed in claim 1 wherein the telescopic tube is composed of a fixed rod, an adjustable rod, a fixing element, a locking element, and a sleeve tube wherein the fixed rod has a cylindrical channel extending at the center therein for the accommodation of the adjustable rod therein, an engaging portion with an externally-threaded section defining thereon and a plurality of washer units mounted thereto protruding at the bottom end thereof, a threaded thru-hole appropriately disposed at the outer periphery at one side of the upper end in communication with the cylindrical channel thereof, and a washer part mounted to the threaded thru-hole to reciprocally register with an outer threaded portion of the fixing element thereof; the adjustable rod has a coupling end defined by a coupling hole protruding at the upper section thereof, a screwed thru-hole appropriately disposed at the outer periphery of one side in communication with the coupling hole thereof, a washer fitting applied to the screwed thru-hole thereof to reciprocally engage with an externally threaded end of the locking element thereof, and a recessed groove defining a predetermined position at the outer periphery of the lower section thereof to form a limiting side at both upper and lower edges respectively; the sleeve tube is equipped with a pivoting hole disposed at the center thereof to form an abutting face therein with an O-shaped ring reciprocally mounted thereto.

13. The easy table tennis training device as claimed in claim 12 wherein the recessed groove of the adjustable rod thereof is made in an elongated shape.

14. The easy table tennis training device as claimed in claim 12 wherein the pivoting hole of the sleeve tube is made in a two-stepwise shape.

15. The easy table tennis training device as claimed in claim 1 wherein the retaining seat has an opening disposed thereon, a retaining cavity communicating with the opening thereof for the accommodation of a ball element therein, an abutting section annularly extending at the upper edge thereon, and an engaged end extending at the bottom section thereof to be reciprocally connected with the coupling end of the adjustable rod thereof.

16. The easy table tennis training device as claimed in claim 1 wherein the base of the retaining mount can be integrally molded of metallic or plastic material and formed in an annular disk shape.

17. The easy table tennis training device as claimed in claim 1 wherein the accommodating case of the retaining mount can be molded of plastic material.

18. The easy table tennis training device as claimed in claim 1 wherein the mattress element accommodated at the retaining mount therein can be made of plastic and rubber material and equipped with a soft property thereof.

19. The easy table tennis training device as claimed in claim 1 wherein the accommodating case of the retaining mount can be made in a rectangular shape and provided with a stepwise bottom surface thereon.

* * * * *